United States Patent [19]

Chieffo

[11] 4,310,987

[45] Jan. 19, 1982

[54] AMUSEMENT DEVICE

[76] Inventor: Joseph M. Chieffo, 1023 Yates Ave., Marcus Hook, Pa. 19061

[21] Appl. No.: 143,498

[22] Filed: Apr. 24, 1980

[51] Int. Cl.[3] ..... A63H 1/00; A63H 17/00

[52] U.S. Cl. ..... 46/251; 46/207; 46/269

[58] Field of Search ..... 46/251, 269, 206, 207

[56] References Cited

U.S. PATENT DOCUMENTS

| | | | |
|---|---|---|---|
| 2,846,814 | 8/1958 | Lettieri | 46/207 |
| 2,949,697 | 8/1960 | Licitis et al. | 46/207 |
| 2,977,714 | 4/1969 | Gibson | 46/269 |
| 3,453,773 | 7/1969 | Compton et al. | 46/207 |
| 3,555,725 | 1/1971 | Orfei et al. | 46/206 |
| 4,090,715 | 5/1978 | Wagner et al. | 273/141 A |
| 4,182,077 | 1/1980 | Wagner et al. | 46/248 |

*Primary Examiner*—Gene Mancene
*Assistant Examiner*—Michael J. Foycik
*Attorney, Agent, or Firm*—Paul Lipsitz

[57] ABSTRACT

A rolling amusement device powered by light falling on solar cells wherein the solar cells constantly face the light source.

1 Claim, 3 Drawing Figures

AMUSEMENT DEVICE

It is known in the art as disclosed in U.S. Pat. No. 3,530,617, for example, to mount motors with unbalanced flywheels or other devices in closed spheres or other rolling shapes to provide momentum to a rolling toy. It is also known to employ solar power to energize a motor which directly drives the wheels of a toy. The present invention is directed to a novel rolling amusement device, wherein the rolling device employs solar cells to power a motor to provide motion and although the device of the invention, when empowered, is in constant rolling motion, it is constructed so that its solar cells are always facing upwardly in order to receive the powering radiation. In essence, the device of the invention comprises a light-transparent cylindrical housing containing a motor fixedly mounted on a central, longitudinal axis, solar cells rotatably affixed above said motor and a weight attached to the bottom of the motor.

Reference is now made to drawings.

Figure 1:
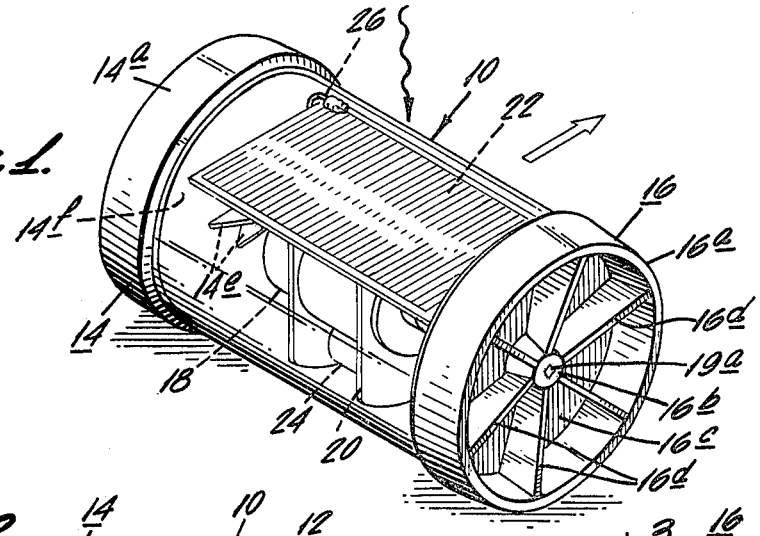
FIG. 1 is a perspective view of the device.
Figure 2:
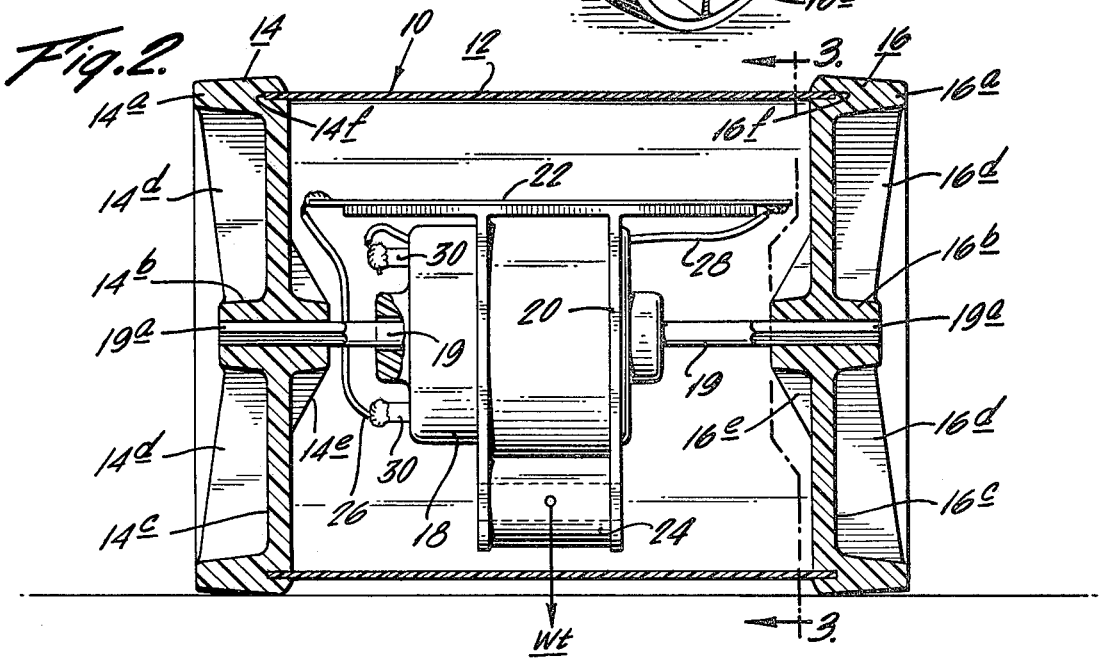
FIG. 2 is an enlarged sectional side elevational view of the device shown in FIG. 1.
Figure 3:
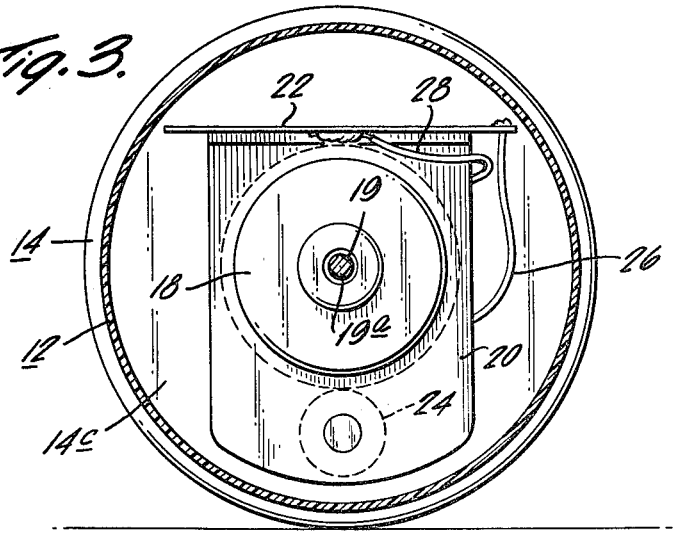
FIG. 3 is a transverse sectional view taken on line 3,3 of FIG. 2.

Referring now to FIGS. 1,2 and 3, the rolling device is designated generally as 10 and comprises a light transparent cylinder 12 of plastic (e.g. acetate) or other suitable material. Means to support the cylinder are provided such as end caps 14 and 16. The end caps 14 and 16 preferably have outwardly directed, slightly tapered flanges 14*a* and 16*a*, a central hub 14*b* and 16*b* and end walls 14*c* and 16*c*. Radially extending ribs 14*d* and 16*d* which span the outward face of the end caps between the hub and flange positions and short, inwardly directed ribs 14*e* and 16*e* (see FIG. 2) may be used to strengthen the inner hub extension. A circumferentially extending groove 14*f* and 16*f* forms a recess for the terminal ends 14 and 16 of the cylinder 12. It will be understood, of course, that other types of construction may be used for the ends of cylinder 12.

Centrally located within the tube 12 is an electrical motor 18 which is axially supported, as, for example, by each end of its armature shaft 19 being fixed to the center of the end caps. The ends of the armature shaft 19 may be flattened, as shown (19*a*) in order to assure a tight, non-slipping fit. It will, of course, be understood that other equivalent means may be used to mount the motor within the cylinder.

The electrical motor 18 has rigidly affixed to it a bracket 20 that supports upon its upper surface solar cells 22 and opposite and below the motor 18 is a counterweight 24 attached to bracket 20.

Electrical leads 26 and 28 run directly from the cells 22 to terminal tabs 30 on the motor 18.

From the above drawings and description it will be understood that as the motor is energized by the solar cells the torque generated causes the cylinder to roll. However, the solar cells supported by bracket 20 are free to move around the motor's armature shaft and because of the weight 24 the solar cells are always held in a face-up position. Thus, although the device moves in a rolling motion, the solar cells constantly face the source of illumination and are thus constantly empowered.

The device is both educational and amusing and may, of course, have colored, decorated end caps and be modified in various other ways as will be understood by the art worker.

The invention claimed is:

1. An amusement device comprising a transparent cylindrical housing having two opposed wheels, containing an axially mounted solar powered motor, means on each wheel for mounting the armature shaft of said motor, solar cells attached to said motor and electrically connected thereto and a weight attached to said motor, whereby, when said device is empowered by light, said energized motor effects rolling motion to said device.

* * * * *